United States Patent [19]

Romak

[11] Patent Number: 4,938,720

[45] Date of Patent: Jul. 3, 1990

[54] ELECTRICAL CONNECTOR

[75] Inventor: Paul E. Romak, Langen, Fed. Rep. of Germany

[73] Assignee: AMP Incorporated, Harrisburg, Pa.

[21] Appl. No.: 362,728

[22] Filed: Jun. 6, 1989

[30] Foreign Application Priority Data

Jul. 21, 1988 [GB] United Kingdom ..... 8817403

[51] Int. Cl.[5] ..... H01R 4/48

[52] U.S. Cl. ..... 439/839; 439/745

[58] Field of Search ..... 439/745, 748, 751, 839, 439/851, 852

[56] References Cited

U.S. PATENT DOCUMENTS 4,341,434 7/1982 Pfister ..... 439/839

4,540,234 9/1985 Konnemann et al. .

FOREIGN PATENT DOCUMENTS 3629740 3/1987 Fed. Rep. of Germany .

*Primary Examiner*—Eugene F. Desmond

*Attorney, Agent, or Firm*—Bruce J. Wolstoncroft

[57] ABSTRACT

An electrical terminal for receiving a pin (15) comprises a rolled socket (2) surrounded by a helper spring sleeve (6). The socket (2) has contact springs (10) with contact bosses (12). The sleeve (6) has spring arms (42) which are provided about the circumference of the sleeve proximate an end (38) thereof. The spring arms (42) are configured to provide a pivoting action when a force is applied thereto. The pivoting action provides for reliable secondary 10 locking, as well as a centering and anti-rotation feature, thereby insuring that a positive electrical connection will be effected between the pin (15) and the socket (2).

9 Claims, 4 Drawing Sheets

ELECTRICAL CONNECTOR

The invention is directed to an electrical terminal which has a secondary locking feature provided thereon. The terminal has a helper spring sleeve which cooperates therewith, the helper spring sleeve providing the positive secondary locking feature required in many instances.

It has become increasingly important to provide a secondary locking member in terminals. This is particularly true in the automotive industry. Consequently, many pin and socket type terminals have been developed which incorporate a secondary locking feature therein.

One such terminal is disclosed in German Utility Model Number 36 29 740. As is shown in the referenced German Utility Model, a terminal is provided with a sleeve which extends about the circumference of the terminal. The sleeve provides support to resilient arms of the terminal and also provides the secondary locking characteristics required. The shoulder of the terminal cooperates with the sleeve to insure that the sleeve is maintained in the proper position relative to the longitudinal axis of the terminal. The shoulder is formed from the material which comprises the terminal. In order to provide the required configuration, the shoulder must be coined. These forming and coining operations can result in the failure of the material at the shoulder. In particular, cracks may develop on the surfaces of the shoulders. This is an unacceptable result which causes the failure of an electrical terminal. Another problem with the stamping and forming operation described is a result of minimal working space. Due to the lack of space available to perform the coining operation, the coining operation can be very time consuming and difficult, thereby resulting in the cost of manufacture of the terminals increasing.

Another problem associated with stamping and forming the shoulders from the terminal relates to the fact that the terminals are not as accurately positioned in the terminal receiving cavities of the connector. The configuration of the shoulder does not allow the shoulder to act as centering means. In other words, due to tolerances, the shoulder must be smaller in diameter than the cavity. When a force is applied to the terminal, the terminal will be allowed to float in the cavity, resulting in an ineffective electrical connection.

It would therefore be beneficial to provide a terminal in which the main body of the terminal did not have to provide a shoulder in order for the terminal to operate. This would eliminate the problem of stamping and coining the material in adverse conditions, thereby essentially eliminating the failure of the terminal due to cracking. In the alternative, it would be beneficial to provide a terminal with a sleeve which provides a centering means, thereby insuring that the longitudinal axis of the terminal will coincide with the longitudinal axis of the cavity. The present invention is directed to such a terminal.

This invention relates to a pin or socket electrical terminal comprising an elongate, tubular, rolled body portion having a longitudinal first seam and a rolled helper spring sleeve surrounding the body portion and having a longitudinal second seam. The body portion of the terminal is formed with slots providing a plurality of contact springs extending essentially longitudinally of the body portion, each contact portion having a contact boss projecting into the passage to engage the pin. The helper spring, which is sometimes known as a backing spring or a support spring, serves to augment the contact force exerted by the contact bosses against the pin when it has been inserted into the body.

The invention is directed to an electrical terminal comprising an elongate, tubular socket which has a pin receiving passage and a helper spring sleeve surrounding the socket. The pin receiving passage extends from a mating end of the socket toward an overinsertion end of socket. The socket is formed with slots, the slots separating a plurality of contact springs provided about the socket, each of the contact springs projects into the passage, to contact the pin. The helper spring sleeve has a first end which is proximate the mating end of the socket and a second end which is proximate the overinsertion end of the socket.

The terminal is characterized by the socket having projections provided proximate the overinsertion end. The projections extend in a direction which is essentially perpendicular to the longitudinal axis of the socket.

The helper spring sleeve has spring arms which are provided about the circumference of the helper spring sleeve proximate the second end thereof. The spring arms are separated from each other by slots which are provided in the helper spring sleeve. Each of the spring arms are formed such that a midportion of each spring arm extends outward from the helper spring sleeve, away from the socket, whereby the projections of the socket cooperate with respective slots provided between the spring arms of the helper spring sleeve, to insure that the helper spring sleeve does not rotate about the socket.

An embodiment of the invention will now be described by way of example with reference to the accompanying drawings, in which.

Figures 5A, 5B:
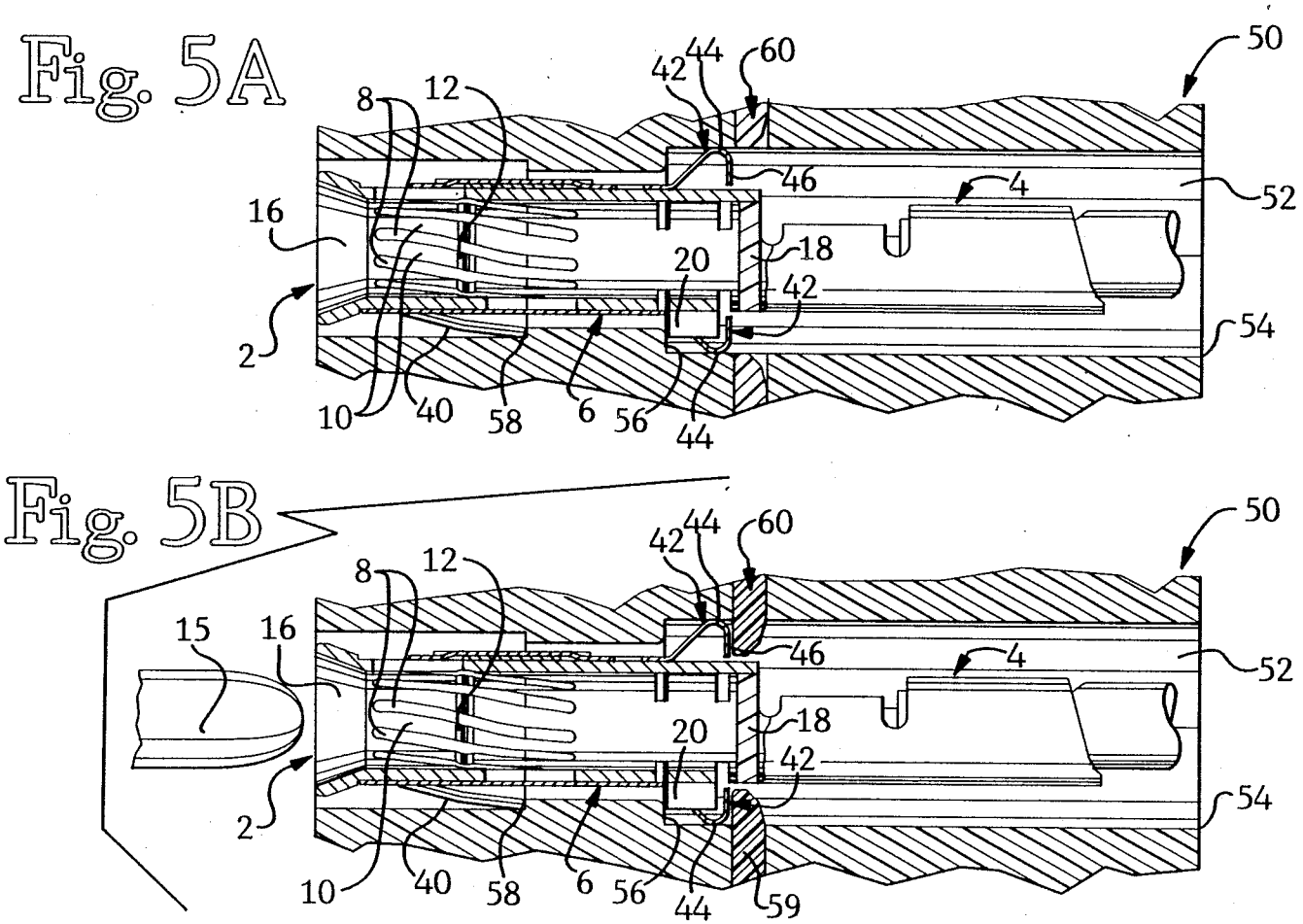
Figure 6:
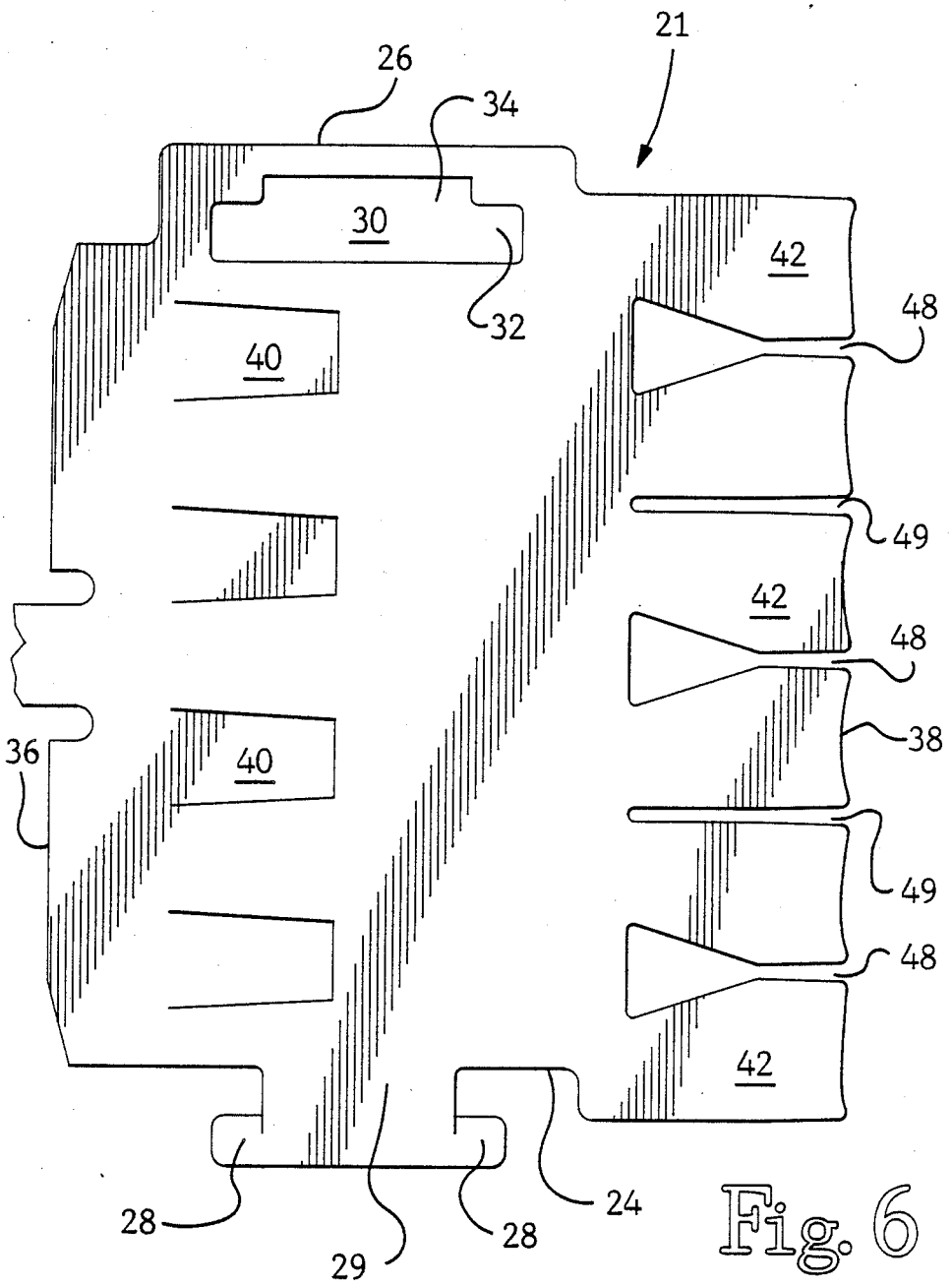

FIG. 5*a* is a cross-sectional view of the terminal, with the secondary locking sleeve provided thereon, inserted into a housing of a connector;

FIG. 5*b* is a cross-sectional view similar to that of FIG. 5*a*, showing a cam member of the housing provided to maintain the terminal in the connector; and FIG. 6 is a plan view of a sheet metal blank for forming the sleeve.

Figure 1:
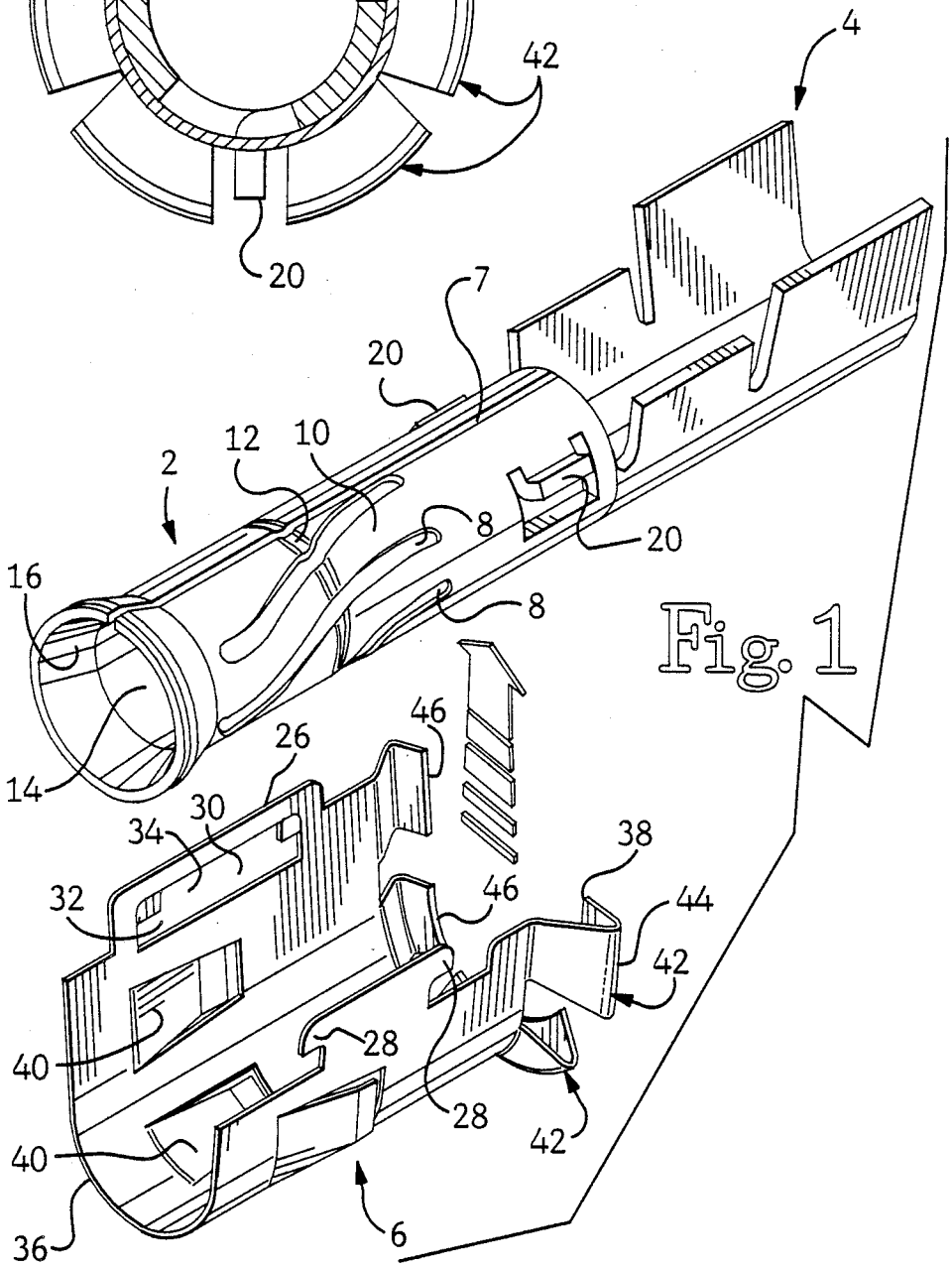
FIG. 1 is a perspective view of a terminal of the present invention with an open secondary locking sleeve exploded therefrom.

As shown in FIG. 1, a terminal comprises an elongate, tubular socket 2 from which extends a crimping ferrule 4. A secondary locking, resilient sleeve 6 is provided in surrounding relationship to socket 2. The socket 2 and ferrule 4 are stamped and formed from a single piece of sheet metal stock, as is the sleeve 6.

It is important to note that the invention is not limited for use with a socket and ferrule. As an example, the terminal can be a pin rather than a socket. However, for ease of explanation, the invention will be described with respect to socket 2 and ferrule 4.

As is best shown in FIG. 1, the socket has a longitudinal seam 7 which extends over its entire length. The socket is formed with a plurality of slots 8 provided in the sidewalls thereof. The slots 8 are essentially parallel to each other, with each slot being at an angle relative to the longitudinal seam 7 of the socket 2. Provided between slots 8 are arms of metal which form contact spring arms 10. The number of contact springs 10 can vary in number according to the particular contact force required for operation. In the embodiment shown, eight contact spring arms are provided.

Figure 3:
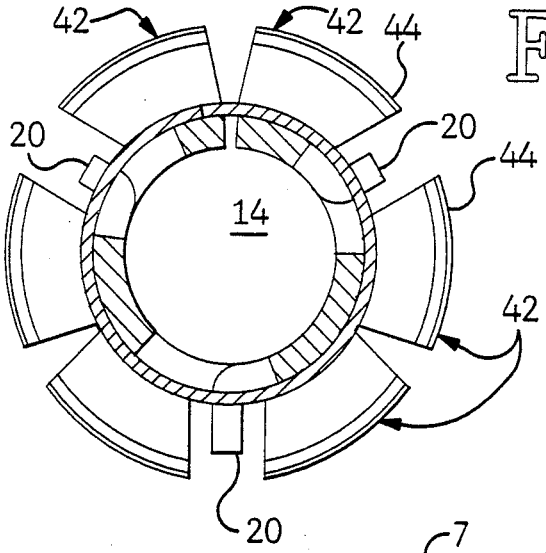
FIG. 3 is a cross-sectional view, taken along line 3—3 of FIG. 2, showing spring arms of the secondary locking sleeve in cooperation with projections of the terminals.

Each contact spring arm 10 has a contact boss 12 projecting into a pin receiving passage 14, the pin receiving passage being best shown in FIGS. 1 and 3. The pin receiving passage 14 is defined by the walls of socket 2. As is shown in the FIGS. 1 and 2, the bosses 12 are arranged in the same plane, substantially at the longitudinal center of contact spring arms 10. However, if a low insertion socket is required, the bosses 12 can be staggered along the longitudinal axis of the socket, thereby facilitating the insertion of pin 15, FIG. 5*b*, into the socket under reduced insertion force conditions.

Passage 14 has a pin receiving end 16 which is defined by a continuous circumferential ring portion which extends about socket 2. The diameter of the pin receiving end 16 is greater than the diameter of socket 2 at the position where bosses 12 are located. This allows pin receiving end 16 to act as a lead-in surface.

A stop plate 18 is provided in passage 14 at an end opposite pin receiving end 16. Stop plate 18 cooperates with pin 15 such that as pin 15 is inserted into socket 2, the pin is prevented from overinsertion. Provided proximate stop plate 18 are anti-rotation projections 20. Projections 20 are stamped from the sidewalls of socket 2 and formed outward, away from stop plate 18. The function of projections 20 will be more fully discussed below. As shown in FIG. 3, three projections 20 are provided, however the number of projections 20 provided about the circumference of socket 2 will vary according to amount of stability required.

Figure 4:
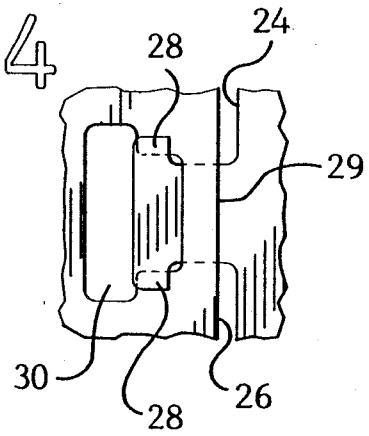
FIG. 4 is a partial view showing the latching means of the secondary locking spring.

As is shown in FIG. 6, sleeve 6 is stamped from a single sheet of rolled metal 21. After stamping sleeve 6 is formed into a pre-assembly position. In this pre-assembly position, the sleeve 6 is open, such that the sleeve is in a substantially U-shaped configuration, as shown in FIG. 1. An edge 24 of sleeve 6 has a pair of identical uniplanar ears 28, the ears project in opposite senses from a stem 29 which in turn projects from the edge 24. An opposite edge 26 of sleeve 6 has an aperture 30 for receiving the ears 28 therein when sleeve 6 is fully assembled to socket 2. Each opening 30 has a wide portion 32 dimensioned to receive ears 28 therein and a narrower portion 34 adjacent to wide portion 32. The keyhole configuration allows ears 28 to be easily inserted into side portion 32 of aperture 30. Stem 29 is then moved into narrow portion 34, such that ears 28 cooperate with the shoulders to latch sleeve 6 onto socket 2, as shown in FIG. 4.

Figure 2:
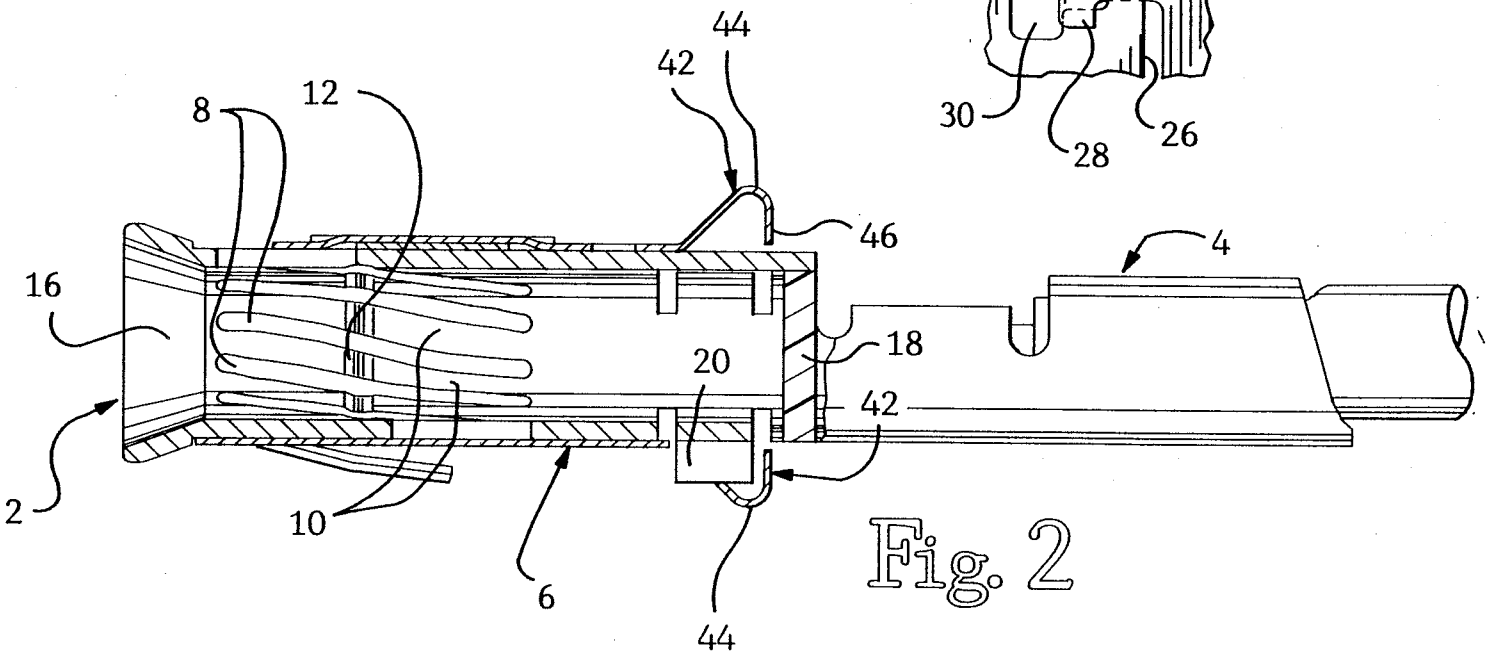
FIG. 2 is partial cross-sectional view of the terminal with the secondary locking sleeve provided thereon.

As can be seen in FIG. 1, sleeve 6 has a first end 36 and a second end 38. Proximate first end 36 are resilient securing arms 40. Securing arms 40 are stamped and formed from the sidewalls of sleeve 6. Provided adjacent second end 38 are resilient locking spring arms 42. Locking spring arms 42 are also stamped from the sidewalls and are formed so that a mid portion 44 extends outward from the sidewalls. End portions 46 of locking spring arms 42 are positioned to lie in essentially the same plane as the sidewall of sleeve 6, as is best shown in FIGS. 2 and 5. Locking spring arms 42 are separated from each other by slots 48, 49, as shown in FIG. 6. The configuration of slots 48, 49 and projections 42 enhance the resilient characteristics of projections 42, as will be more fully discussed below.

In order to assemble the sleeve 6 to the socket 2, sleeve 6 is placed in socket 2, when the sleeve is in the pre-assembly position, as indicated by the arrow in FIG. 1. Sleeve 6 is compressed to move the edges 24 and 26 toward each other, so that ears 28 are inserted through wide portion 34 of opening 30. With ears 28 properly seated in wide portion 34 of opening 30, the pressure on the sleeve 6 is relaxed causing edges 24, 26 to move away from each other, forcing ears 28 into narrow portion 34 of opening 30. This cooperation of ears 28 and opening 30 provides a type of latching arrangement, whereby the sleeve 6 is secured to the socket 2 (see FIG. 4).

Sleeves 6 and pins 15 are so relatively dimensioned that when the pins are inserted into the passages 14 of the sockets 2, the pins engage the bosses 12, thereby deflecting the contact spring arms 10 radially outwardly of the sockets 2 until further radial outward deflection of sockets 2 is resiliently constrained by sleeves 6 just prior to pins 15 butting against stop plates 18. The resulting hoop stresses ensure that a final high contact force is exerted against each pin 15 by the contact bosses 12. The manner in which the sleeves 6 are slipped about the socket 2 as described above, leaves clearance between the sockets 2 and the sleeves 6, thereby avoiding damage to sockets 2, during the assembly thereto of sleeves 6. It should also be noted, that the clearance allows for the initial insertion force of pins 15 into sockets 2 to be low.

With each sleeve 6 properly inserted on a respective socket 2, the assembled terminals are inserted into an insulated housing 50, FIG. 5*a* and 5*b*. The insulating housing can have a cam provided therein or can be of a two part construction. Referring to FIG. 5*a*, each assembled terminal is inserted into a respective terminal receiving cavity 52 of housing 50 through a first major surface 54 of the housing. The terminal is fully inserted when projections 20 engage shoulders 56 of housing 50. As this occurs, resilient securing arms 40 cooperate with shoulders 58. The cooperation of projections 20 and resilient securing arms 40 with respective shoulders 56, 58 prevents the movement of the terminals along the longitudinal axis of cavities 52.

With the terminals maintained in the cavities, portions 59 of cam 60 or second housing are positioned in cavities 52, as shown in FIG. 5*b*. The positioning of the cam in the cavity provides a shoulder 62 which cooperates with locking spring arms 42 to provide secondary locking for the terminal.

In the fully assembled position, the terminal is prevented from movement in a direction which is transverse to the longitudinal axis of cavity 52. Locking spring arms 42 cooperate with the sidewalls of the cavity to insure that the longitudinal axis of the socket coincides with the longitudinal axis of the cavity.

The configuration of locking spring arms 42 provides for a strong secondary locking action. As pins 15 are inserted into sockets 2, a force is exerted on the terminals. This force is in the direction of insertion, which causes the terminals to move toward surface 54. As this movement occurs, locking spring arms 42 engage portions 59 of cam 60. This engagement causes locking spring arms 42 to deform in such a manner as to maintain the terminals in the required position both longitudinally of the axis and transversely. As locking spring arms 42 cooperate with portions 59, locking spring arms 42 are forced to pivot. This pivoting motion causes midportions 44 of locking spring arms 42 to move toward respective sidewalls of cavities 52, thereby apply a force to the sidewalls of the cavities. This force is equally distributed about the circumference of each of the terminals and prevents the movement of the terminals in a direction which is transverse to the longitudinal axis of the cavity. It should be noted, that the frictional engagement of midportions 44 against the sidewalls also helps to distribute the forces along the sidewalls, thereby alleviating the problem of large forces being applied to portions 59 of cam 60.

As locking spring arms 42 pivot, the portions of sleeves 6, which are proximate locking spring arms 42, are caused to move inward, toward sockets 2. This inward movement causes each sleeve 6 to exert an increased force on a respective socket 2. This is a beneficial result, as it insures that sleeves 6 will be maintained in position relative to sockets 2, no matter what force is applied to the terminals. The larger the force applied to the terminals, the more deflection of the of sleeves 6, thereby insuring that sleeves 6 will be maintained in position relative to respective sockets 2, despite the amount of force which may be applied to the terminals. Consequently, the configuration of the present invention provides a very secure and stable secondary locking feature.

The cooperation of projections 20 and locking spring arms 42 also prevents the rotation of the terminals in the housing. As described above, during the insertion of pins 15 into sockets 2, the locking spring arms 42 are forced into frictional engagement with the sidewall of cavities 52. This frictional engagement prevents the movement of midportions 44 of locking spring arms 42 relative to the sidewalls. Therefore, as projections 20 are positioned and maintained in slots 48 (which are provided between locking spring arms 42), projections 20 are prevented from rotation as pins 15 are inserted into sockets 2.

Changes in construction will occur to those skilled in the art and various apparently different modifications and embodiments may be made without departing from the scope of the invention. The matter set forth in the foregoing description and accompanying drawings is offered by way of illustration only.

What is claimed:

1. An electrical terminal comprising:

an elongate, tubular socket having a pin receiving passage and a helper spring sleeve surrounding the socket, the pin receiving passage extending from a mating end of the socket toward an overinsertion end of socket, the socket being formed with slots providing a plurality of contact springs, each contact spring projecting into the passage, the helper spring sleeve having a first end which is proximate the mating end of the socket and a second end which is proximate the overinsertion end of the socket;

the socket having projections provided proximate the overinsertion end, the projections extend in a direction which is essentially perpendicular to the longitudinal axis of the socket;

the helper spring sleeve having spring arms which are provided about the circumference of the helper spring sleeve proximate the second end thereof, the spring arms are separated from each other by slots which are provided in the helper spring sleeve, each of the spring arms are formed such that a midportion of each spring arm extends outward from the helper spring sleeve, away from the socket;

whereby the projections of the socket cooperate with the slots provided between the spring arms of the helper spring sleeve to insure that the helper spring sleeve does not rotate about the socket.

2. An electrical terminal as set forth in claim 1 wherein the projections are positioned in the slots which are provided between the spring arms, such that the projections are prevented from rotating relative to the helper spring sleeve, which prevents the entire terminal from rotation relative to the helper spring sleeve.

3. An electrical terminal as set forth in claim 1 wherein the spring arms are caused to pivot about fixed ends when a force is applied proximate the free ends of the spring arms, thereby allowing the midportions to move away from the longitudinal axis of the terminal.

4. An electrical terminal as set forth in claim 3 wherein as the spring arms are forced to pivot, a portion of the helper spring sleeve which is proximate the fixed ends is forced to move toward the longitudinal axis of the terminal, such that the helper spring sleeve engages sidewalls of the socket to insure that the terminal is maintained in position relative to the helper spring sleeve.

5. An electrical terminal for use in a connector, the terminal comprising:

an elongate, tubular socket having a pin receiving passage and a helper spring sleeve surrounding the socket, the pin receiving passage extending from a mating end of the socket toward an overinsertion end of socket, the socket being formed with slots providing a plurality of contact springs, each contact spring projecting into the passage, the helper spring sleeve having a first end which is proximate the mating end of the socket and a second end which is proximate the overinsertion end of the socket, the connector having a housing which has terminal receiving cavities dimensioned to receive the terminals therein, the helper spring sleeve having resilient locking arms which cooperate with walls of the terminal receiving cavities to lock the terminal in the housing;

the socket having projections provided proximate the overinsertion end, the projections extend in a direction which is essentially perpendicular to the longitudinal axis of the socket;

the helper spring sleeve having spring arms which are provided about the circumference of the helper spring sleeve proximate the second end thereof, the spring arms are separated from each other by slots which are provided in the helper spring sleeve, each of the spring arms are formed such that a midportion of each spring arm extends outward from the helper spring sleeve, away from the socket, the midportions of the spring arms extend from the helper spring sleeve a greater distance than the projections of the socket, whereby as a force is applied to the ends of the spring arms, the spring arms are caused to pivot about a pivot point, thereby insuring that the helper spring sleeve is adequately secured to the socket.

6. An electrical terminal as set forth in claim 5 wherein the projections are positioned in the slots which are provided between the spring arms, such that the projections are prevented from rotating relative to the helper spring sleeve, which prevents the entire terminal from rotation relative to the helper spring sleeve.

7. An electrical terminal as set forth in claim 5 wherein the spring arms are caused to pivot about fixed ends when a force is applied proximate free ends of the spring arms, thereby allowing the midportions to move away from the longitudinal axis of the terminal, to engage sidewalls of the terminal receiving cavities 8. An electrical terminal as set forth in claim 7 wherein the spring arms cooperate with shoulders of the connector to provide the force required to pivot the spring arms.

9. An electrical terminal as set forth in claim 7 wherein as the spring arms are forced to pivot, a portion of the helper spring sleeve which is proximate the fixed ends is forced to move toward the longitudinal axis of the terminal, such that the helper spring sleeve engages sidewalls of the socket to insure that the terminal is maintained in position relative to the helper spring sleeve.

* * * * *